United States Patent [19]

Lewis et al.

[11] 4,297,677

[45] Oct. 27, 1981

[54] PERSONAL AMBIENT SOUND REFERENCED ANNUNCIATOR

[75] Inventors: John S. Lewis, 8525 Wolftrap Rd., Vienna, Va. 22180; Edmond P. DiGiannantonio, 1638 Wateredge La., Reston, Va. 22070; Howard R. Boyle, Alexandria, Va.

[73] Assignees: John S. Lewis, Vienna; Edmund P. DiGiannatonio, Reston, both of Va.

[21] Appl. No.: 101,735

[22] Filed: Dec. 10, 1979

[51] Int. Cl.[3] ..... G08B 13/00

[52] U.S. Cl. ..... 340/148; 340/407; 340/566

[58] Field of Search ..... 340/407, 566; 179/1 MN; 367/93

[56] References Cited

U.S. PATENT DOCUMENTS

| | | | |
|---|---|---|---|
| Re. 28,213 | 10/1974 | Kegan | 340/311 X |
| 2,580,598 | 1/1952 | Rody | 340/407 |
| 2,764,640 | 9/1956 | Osserman | 340/407 |
| 3,017,631 | 1/1962 | Fink | 343/225 |
| 3,582,671 | 6/1971 | Ott | 307/117 |
| 3,742,359 | 6/1973 | Behymer | 340/407 |
| 3,786,628 | 1/1974 | Fossard | 58/152 B |
| 3,911,416 | 10/1975 | Feder | 340/311 |
| 3,914,692 | 10/1975 | Seaborn | 340/407 |
| 3,984,708 | 10/1976 | Holmlund | 310/30 |
| 4,028,882 | 6/1977 | Muncheryan | 58/152 B |
| 4,134,109 | 1/1979 | McCormick | 340/566 |
| 4,139,742 | 2/1979 | Walker | 179/107 BC |
| 4,170,769 | 10/1979 | Morris | 340/566 |
| 4,180,810 | 12/1979 | Muncheryan | 340/407 |
| 4,225,859 | 9/1980 | Zetting | 340/566 |

*Primary Examiner*—Harold I. Pitts

[57] ABSTRACT

A personally worn or portable annunciator device for alerting, warning, training, communicating or diagnostic use for people especially those with hearing impairments. This device which can be activated locally or remotely has as one of its means of generating a tactile sensation a transducer or buzzer, as well as a visual light both of which are activated automatically upon the detection of an audio signal substantially above the local ambient noise, or by a RF signal remotely generated by an auxiliary unit.

9 Claims, 5 Drawing Figures

PERSONAL AMBIENT SOUND REFERENCED ANNUNCIATOR

BACKGROUND AND HISTORY OF THE INVENTION

This invention relates to a device for people with or without hearing impairments. In particular this invention is designed to be small and portable and worn on the person or placed near the person as to be readily visible Noises generated by ringing telephones, falling objects, car horns, alarms or spoken warnings are not noticed especially by deaf people. For example a smoke detector could be associated with this invention which will cause an audible signal which will trigger the device. When driving a car, car horns or sirens often indicate a situation where caution is called for. However, a deaf person cannot hear these sounds and may not realize that there is potentially hazardous situations present. In factories, audible alarms may go unheeded by people especially the deaf. By not being able to hear warnings a person may imperil his own or someone elses life.

Prior devices to warn people have not been adequate. One of the reasons for this is that they activated the alarm when a noise was present and did not automatically take into account the local ambient noise level. As such, in a noisy factory, the alarm would be on all the time. Additionally, many activated during a normal conversation. With the alarm activating continuously, a person would begin to ignore the alarm which would make the warning device useless. Also, many of the prior warning devices were of a highly complex nature and expensive to mass produce.

This invention can be activated by a local acoustic signal or by a remote RF link. In the latter mode, the signal can be specially encoded for individual communication to a specific user in a large group of individuals who might be wearing or otherwise using a similar device so as to program specific functions to a selected individual.

Many of the prior devices were designed to work in a specific environment. For example, U.S. Pat. No. 2,580,598 is designed to wake up a deaf person. This unit is not portable and is only useful in that one environment. U.S. Pat. No. 4,139,742 is specifically made to transmit voice communications by radio. This device has no provisions for audible noise detection for use in providing a warning. Additionally none of the prior devices had a means for varying the trigger threshold to allow for different noise environments such as a noisy factory or a quiet house.

In view of the foregoing, it is the object of this invention to provide a device for people to perform numerous functions, the key feature of which is the ability of the device to automatically adjust to the ambient background noise level and trigger off when any audio signal occurs at a preselected level above the ambient.

Another object of this invention is to alert the wearer to impending danger.

A further object of this invention is to arouse a sleeper when a noise above ambient occurs.

Yet another object of this invention is to provide a device for training or instruction of those who have hearing impairments.

Still a further object of this invention is to provide a device for communicating, paging or summoning the user.

Another object of this invention is to provide a device for use in medical clinics, hospitals and the like for diagnostic purposes.

Another object of this invention is to provide a warning device that is portable and has the ability to operate by remote control.

Still another object of this invention is to provide a warning device that is easily attached to the wrist of the user.

A further object of this invention is to provide a warning device that can be easily and inexpensively mass produced.

DESCRIPTION OF THE DRAWINGS

Referring now to FIG. 1, crystal microphone 2 is connected through the input coupling network, capacitor 4 and resistor 6, to the input of the first operational amplifier (Op Amp) 8. Resistor 10 serves as the feedback resistor for the first Op Amp 8. Resistor 12 feeds the output from Op Amp 8 to the input capacitors 14 and 16. The input capacitor 14 feeds the signal from resistor 12 to the inverting input of Op Amp 18. Feedback resistor 20 connects the output of Op Amp 18 to the inverting input of Op Amp 18. Capacitor 22 feeds the output from Op Amp 18 to the filter capacitor 24 and to the voltage divider, resistors 26 and 28. The junction of resistors 26 and 28 is connected to the inverting input of Op Amp 30.

Figure 1:
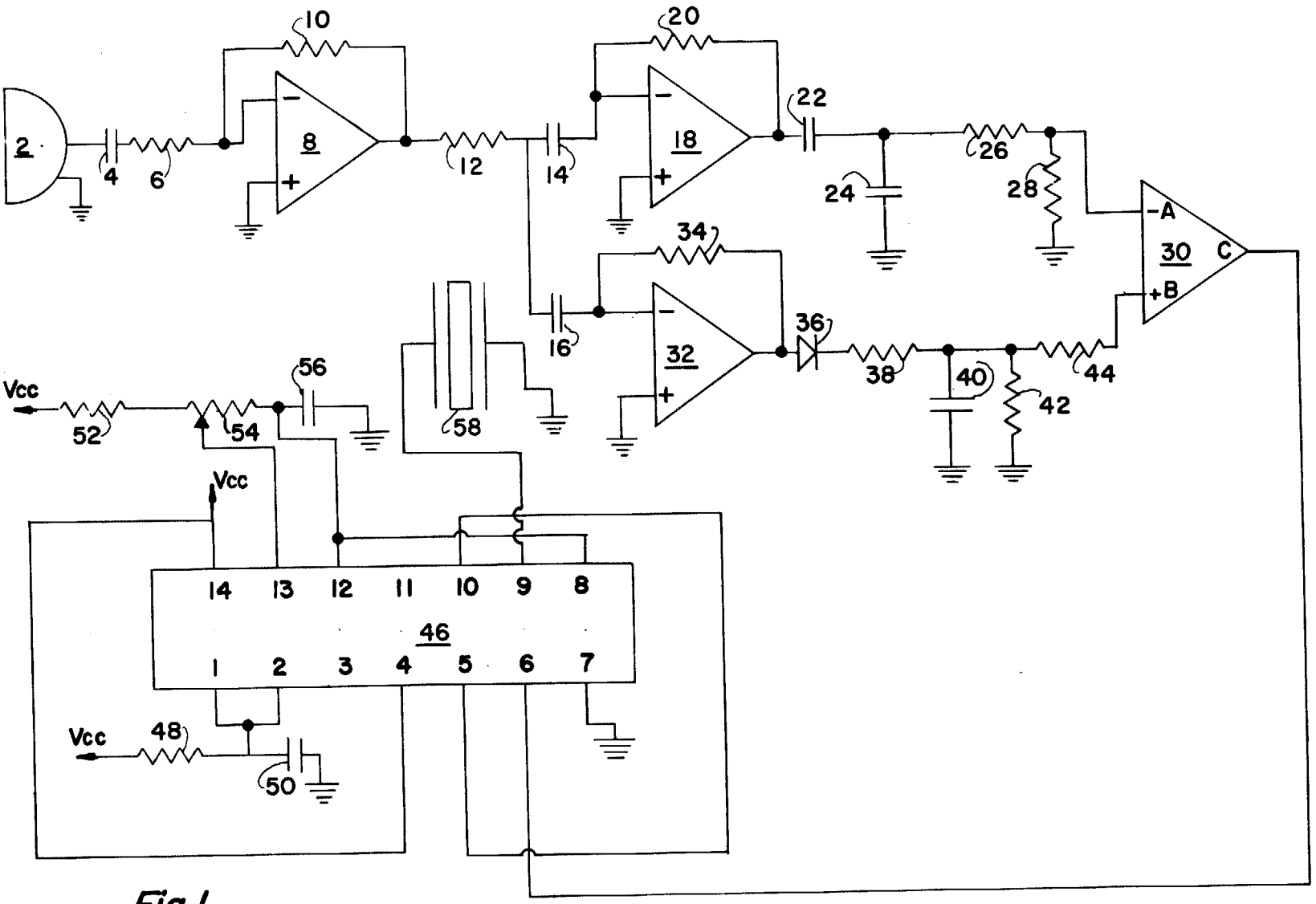
FIG. 1 is a schematic diagram of the warning responder.

The input capacitor 16 feeds the output from resistor 12 to the non-inverting input of Op Amp 32. The feedback resistor 34 connects the output of Op Amp 32 to the inverting input of Op Amp 32. The output network for Op Amp 32 is comprised of diode 36 and resistor 38. The output signal from resistor 38 is fed to the time delay network, capacitor 40 and resistor 42, and to the input resistor 44. The output from Op Amp 38 is connected to the first input, pin 6, of timer 46.

The time delay network, resistor 48 and resistor capacitor 50 is connected between the collector supply voltage (Vcc) and ground. The junction of the resistor 48 and capacitor 50 is connected to pins 1 and 2 of the timer 46. The output from the first timer section, pin 6, is connected to the second timer section reset input, pin 10. The junction of resistors 52 and 54 is connected to the second timer section, pin 13. Pins 12 and 8, the trigger input and the reference voltage input of the second timer section, is connected to the junction of resistor 54 and capacitor 56. The output from the second timer section, pin 9, is connected to a piezoelectric transducer 58.

Figure 2:
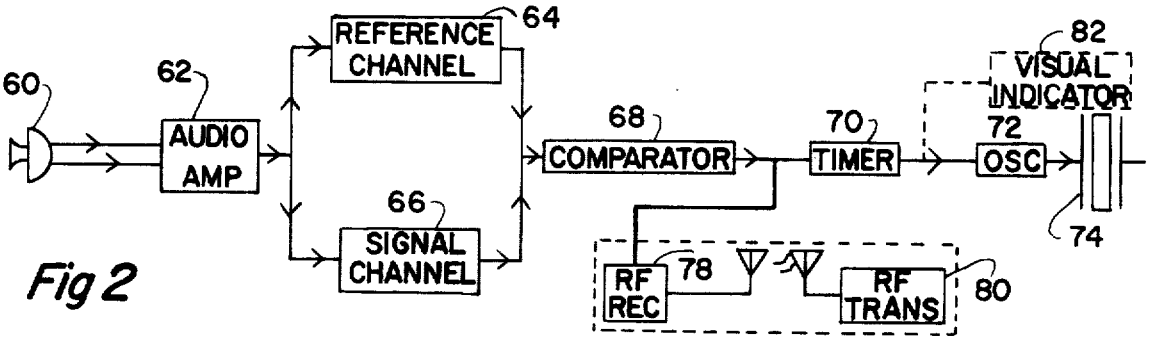
FIG. 2 is a block diagram of the warning responder showing, in broken lines, the optional visual indicators and the radio frequency receiver and transmitter.

As shown in FIG. 2, the microphone 60 is connected to an audio amplifier 62. The output from the amplifier 62 connects to the input of both the reference channel 64 and the signal channel 66 each provides an output to one of the inputs of comparator 68. Timer 70 is connected between the output of comparator 68 and the input to oscillator 72. The output of oscillator 72 is connected to the piezoelectric transducer 74. The optional RF system 76 consists of a radio frequency receiver 78 and a transmitter 80. The output of the receiver 78 is connected to the input of the timer 70.

Visual indicator 82 is optional and can be connected to the output of timer 70.

Figure 3:
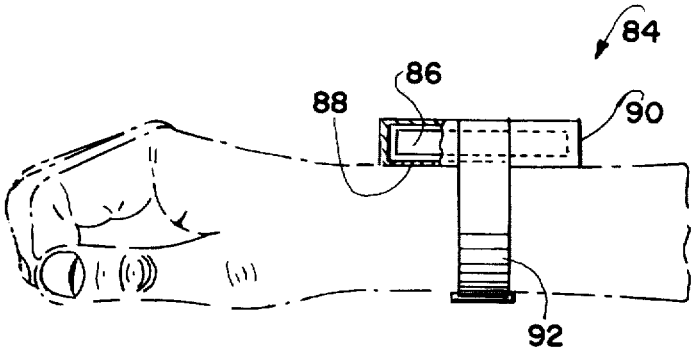
FIG. 3 is a side elevational view of the warning responder mounted upon the wrist of a user, a section of the housing is shown in cross section.

In FIG. 3, the warning responder 84 is shown attached to the wrist of a user. The cross section shows, the electronics board 86 and the transducer 88. The housing 90 is attached to the wrist by the band 92.

Figure 4:
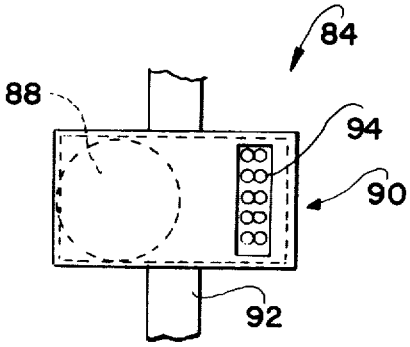
FIG. 4 is a top plan view of the warning responder.
Figure 5:
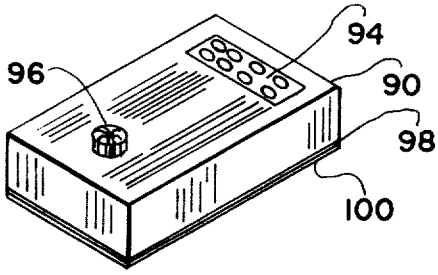
FIG. 5 is an isometric view showing the optional visual indicator mounted on top of the case.

As is shown in FIGS. 4 and 5, microphone 94 is shown mounted in the top of housing 90. The light is an optional visual indicator mounted on the top of housing 90. Additionally, adhesive layers 98 and 100 are optional and permit the housing 90 to be attached to a hard surface (not shown).

OPERATION

Referring now to FIG. 1: the first audio stage is comprised of input capacitor 4 and resistors 6 and 10, and Op Amp 8. Resistors 6 and 10 determine the gain of Op Amp 8. The approximate gain is approximately equal to resistance value of resistor 10 divided by the resistance value of resistor 6.

The input capacitor 4 is selected so as to give the first audio stage the desired frequency response. In general, the lower in capacitance capacitor 4 is, the less gain the stage will have for low frequencies.

The signal channel is comprised of Op Amp 18, capacitors 14, 22 and 24, and resistors 12, 20, 26 and 28. The approximate gain of the Op Amp 18, is like that of Op Amp 8, is given by resistor 20 divided by resistor 12. Capacitor 14 serves to isolate the inverting input of Op Amp 18 from other stages. The capacitor 22 couples the output from Op Amp 18 to the voltage divider, resistors 26 and 28. Filter capacitor 24 smooths out the output signal from the Op Amp 18. Resistors 26 and 28 are selected so as to give a voltage division of five-to-one. These resistors 26 and 28 set the amplitude the input signal needs to be in order to activate the responder. In this case, the input signal has to be five times the amplitude of the ambient noise level.

The reference channel is comprised of diode 36, Op Amp 32, capacitors 16, 40 and 42, and resistors 12, 34, 38,42, 44. As before, resistors 12 and 34 determine the gain of Op Amp 32. Capacitor 16 isolates the inverting input of Op Amp 32 from signal channel stage. Diode 36 isolates the output of Op Amp 32 from the positive voltages in the rest of the circuitry in the reference channel stage. Resistors 38 and 42, and capacitor 40 form a delay network. The approximate delay time is the resistance of resistor 38 multiplied by the capacitance of capacitor 40.

Resistor 42 serves to discharge capacitor 40. This resistor enables the voltage across capacitor 40 to decrease as the ambient noise decreases. The value of resistor 42 can be changed to permit a faster or slower recovery of the reference channel stage. If the value of resistor 42 is decreased, the voltage across capacitor 40 will decrease proportionally with time. The resistance of resistor 38 can be varied to increase or decrease the time it takes the voltage across capacitor 40 to reach the reference level. Output resistor 44 provides isolation and coupling of the Op Amp 30.

The comparator stage consists of Op Amp 30. This Op Amp 30 compares the non-inverting input A to the inverting input B. If the voltage on input A is greater than the voltage B, the output C will ground the trigger input, pin 6, of the timer 46.

The first timer stage consists of pins 1,2, 4, 5 and 6, and resistor 48 and capacitor 50. The pin functions for the first timer section are as follows:

Pin 4 is the reset.

Pin 5 is the output.

Pin 6 is the trigger input.

The first timer section is connected in a monostable 10 configuration and keeps the activator on for the desired time. The time delay is determined by the following formula:

$$\text{Time} = (1.1)R_1C_1$$

$R_1$ is the resistance of resistor 48.

$C_1$ is the capacitance of capacitor 50.

The output, pin 5, is connected to the reset, pin 10, of the second timer section.

The second timer section consists of pins 8, 9, 10, 12 and 13, and resistors 52 and 54, and capacitor 56. The pin functions for the second timer section are as follows:

Pin 8 is the trigger input.

Pin 9 is the output.

Pin 10 is the reset.

The second timer section is connected in an astable configuration and generates a frequency for the transducer 58. The frequency of oscillation is given by the following formula.

$$f = 1.44/(R_1 + 2R_2)C_1$$

$R_1$ is the resistance of resistor 52 in ohms.

$R_2$ is the resistance of resistor 54 in ohms.

$C_1$ is the capacitance of capacitor 56 in farads.

The output of the second timer section, pin 9, is connected to the piezoelectric transducer 58. This transducer 58 vibrates and when placed on the skin the vibrations can be felt. It should be understood that although a piezoelectric transducer is used, other vibration generators may achieve the same results.

Referring now to FIG. 2, this figure shows in block diagram format the circuitry shown in FIG. 1. However, there are two options shown. The first option is indicated by the reference number 76. This option includes a radio frequency receiver which will activate the timer 70 upon reception of a signal from transmitter 80. The second option is the addition of a visual indicator 82 which is activated by the output from the timer 70. A warning responder with the visual option shown in FIG. 5, as is readily understood, may not need the piezoelectric transducer 74.

Although the warning responder is shown encased in one housing, other arrangements may achieve the same effect. In general, when the unit is worn by the user as in FIG. 3, the transducer 88 is mounted so as to be in contact with the skin.

Typical component values are as follows:

| Ref. No. | Resistors | Value |
|---|---|---|
| 6 | | 10 K ohm |
| 10 | | 10 meg ohm |
| 12 | | 1 meg ohm |
| 20 | | 10 meg ohm |
| 26 | | 1 meg ohm |

-continued

| | | |
|---|---|---|
| 28 | | 220 K ohm |
| 34 | | 10 meg ohm |
| 38 | | 10 K ohm |
| 42 | | 470 K ohm |
| 44 | | 1 meg ohm |
| 48 | | 100 K ohm |
| 52 | | 33 K ohm |
| 54 | | 25 K ohm pot. |
| Ref. No. | Capacitors | Value |
| 4 | | .01 Microfarads |
| 14 | | .1 Microfarads |
| 16 | | .1 Microfarads |
| 22 | | .01 Microfarads |
| 24 | | .01 Microfarads |
| 40 | | 100 Microfarads |
| 50 | | 100 Microfarads |
| 56 | | 1 Microfarads |
| Ref. No. | Diode | Type |
| 36 | | 1N 914 |
| Ref. No. | Integrated Circuits | Type |
| 8 | | ¼LM 3900 |
| 18 | | ¼LM 3900 |
| 30 | | ¼LM 3900 |
| 32 | | ¼LM 3900 |
| 46 | | NE 556 |

While this invention has been described as having a preferred design, it will be understood that it is capable of further modification. This application is, therefore, intended to cover any variation, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A personal annunciator responsive to present ambient sound conditions in the immediate vicinity of the user who is unable to recognize changes in ambient sound level, comprising:

(a) a small portable housing, (b) an indicator connected to said housing, (c) ambient sound receiving means disposed in the housing for picking up the continually varying present ambient sound in the vicinity of the housing and producing a variable amplitude signal reflecting the varying amplitude of the present ambient sound, (d) activating signal generating means disposed in the housing and connected to the output of the ambient sound receiving means for receiving the variable amplitude signal therefrom and producing an activating signal only when an abrupt amplitude increase occurs within a fixed predetermined interval, said amplitude being greater by a fixed predetermined increment than the varying sound level received immediately therebefore to which it is referenced, and (e) the activating signal generating means is connected to the indicator, which on receipt of the activating signal gives the user a non-audible type warning signal which he can readily recognize.

2. The personal annunciator as set forth in claim 1, wherein:

(a) the housing size is small enough to permit it to be carried on the wrist of the user.

3. The personal annunciator as set forth in claim 2, wherein:

(a) the indicator includes a vibration generator disposed in physical contact with the user and which vibrates when the indicator receives the activating signal.

4. The personal annunciator as set forth in claim 1, wherein:

(a) the indicator includes a light producing generator.

5. The personal annunciator as set forth in claims 1, 2, 3, or 4, wherein:

(a) timing means is associated with the indicator for continuing the indicator signal output for a predetermined length of time.

6. The personal annunciator as set forth in claims 1, 3, or 4, wherein:

(a) the activating signal generating means contains a threshold circuit referenced to prior received ambient sound levels and which produces a signal when a sound level is received which has a predetermined greater value than the ambient sound level previously received.

7. The personal annunciator as set forth in claims l, 3 or 4, wherein:

(a) the activating signal generating means includes an automatic ambient sound level signal adjusting circuit.

8. The personal annunciator as set forth in claims 1, 3, or 4, wherein:

(a) a radio frequency receiver is contained within the housing and connected to the indicator for supplying an activating signal when a given radio frequency signal is received.

9. The personal annunciator as set forth in claims 1 or 3, wherein:

(a) the ambient sound receiving means includes an audio pick-up connected to at least one amplifier stage, and (b) a comparator circuit is connected to the output of the amplifier stage and is referenced to the ambient audio level signal received from the amplifier stage.

* * * * *